US005325692A

United States Patent [19]

Hoshino et al.

[11] Patent Number: 5,325,692

[45] Date of Patent: Jul. 5, 1994

[54] METHOD OF CONTROLLING TRANSVERSE SHAPE OF ROLLED STRIP, BASED ON TENSION DISTRIBUTION

[75] Inventors: Ikuya Hoshino; Tatsuro Matsuura; Teiichi Abe, all of Nagoya; Atsushi Kimura, Ichinomiya; Yukihiro Maekawa, Nagoya, all of Japan

[73] Assignee: Sumitomo Light Metal Industries, Ltd., Japan

[21] Appl. No.: 951,803

[22] Filed: Sep. 28, 1992

[51] Int. Cl.[5] ..... B21B 37/00

[52] U.S. Cl. ..... 72/8; 72/11; 72/17

[58] Field of Search ..... 72/8, 10, 11, 17, 19, 72/20

[56] References Cited

U.S. PATENT DOCUMENTS

| | | | |
|---|---|---|---|
| 4,587,819 | 5/1986 | Hausen | 72/17 |
| 4,633,693 | 1/1987 | Tahara et al. | 72/17 |
| 4,726,213 | 2/1988 | Manchu | 72/17 |
| 4,753,093 | 6/1988 | Siemon et al. | 72/17 |

FOREIGN PATENT DOCUMENTS

| | | |
|---|---|---|
| 58-15201 | 3/1983 | Japan . |
| 1-50485 | 10/1989 | Japan . |
| 82/03804 | 11/1982 | World Int. Prop. O. . |

*Primary Examiner*—Lowell A. Larson
*Assistant Examiner*—Thomas C. Schoeffler
*Attorney, Agent, or Firm*—Parkhurst, Wendel & Rossi

[57] ABSTRACT

A method of controlling a transverse shape of a strip rolled by a rolling mill having a plurality of shape correcting devices, the method including the steps of detecting a change in a strip rolling force, and a tension distribution of the rolled strip in the width direction. Based on the detected tension distribution, a strain distribution of the rolled strip is calculated, and the calculated strain distribution is used to calculate a shape parameter which represents a shape error of the rolled strip. Based on the detected change in the rolling force and the calculated shape parameter, disturbance values of the rolling mill which should be zeroed by the shape correcting devices are estimated so as to offset a delay in the detection of the tension distribution which is reflected on the shape parameter. The shape correcting devices are controlled according to the estimated disturbance values, without an influence of the delay in the detection of the tension distribution.

5 Claims, 4 Drawing Sheets

METHOD OF CONTROLLING TRANSVERSE SHAPE OF ROLLED STRIP, BASED ON TENSION DISTRIBUTION

BACKGROUND OF THE INVENTION

1. Field of the Invention

The present invention relates in general to a method of controlling the shape of a strip rolled by a rolling mill, and more particularly to a method suitable for precisely controlling the shape of the rolled strip in its width direction.

2. Discussion of the Prior Art

A rolling mill having four or six rolls is known for rolling an aluminum strip or other metal strips. To avoid defects or shape errors so-called "edge wave" along the edges of the rolled strip and "center buckling" in a middle portion of the rolled strip as viewed in the direction of width of the strip, there have been used various shape correcting devices such as: press-down or roll tilt adjusting device for tilting a pair of work rolls of the mill; work roll bending force adjusting device for adjusting the bending force applied to the work rolls; bending force differential adjusting device for adjusting a difference between the bending force values as measured at both ends of the rolls; and intermediate roll bending force adjusting device for adjusting the bending force applied to intermediate rolls between which the work rolls are disposed. These shape correcting devices function to make appropriate corrections to eliminate the shape errors of the rolled strip.

An example of a strip shape control system for a thin-strip rolling mill is disclosed in Publication 1-50485 (1989) of examined Japanese Patent Application. This strip shape control system includes a shape sensor having a plurality of sensing elements disposed at different positions in the direction of width of the strip, and providing output signals which collectively represent the strip shape. The strip shape control system further includes a plurality of shape correcting devices such as: bending mechanisms for bending the rolls in the horizontal plane; bending mechanisms (usually referred to as "jacks") for bending the rolls in the vertical plane, and press-down or tilting mechanism (usually referred to as "screws") for tilting the rolls in the vertical plane. A controller capable of performing arithmetic operations is provided to obtain the shape distribution of the rolled strip detected by the shape sensor, and a calculated desired shape distribution of the strip, as functions of the transverse position in the width direction of the strip. Further, the detected shape distribution is obtained as a function of the transverse position of the strip, with respect to the unit operation amount of each shape correcting device. Based on these functions obtained, the controller calculates an evaluating function for evaluating the shape of the rolled strip over the entire width of the strip, and calculates the operation amounts of the shape correcting devices that minimize the evaluating function, so that the shape correcting devices are activated by the calculated operation amounts, to control the transverse shape distribution of the rolled strip.

However, the known shape control system or method for a thin-strip rolling mill indicated above is susceptible to an influence of a delay in the detection of the strip shape distribution by the shape sensor, which inevitably results in delayed response of the adjusting actuators of the roll bending and tilting mechanisms ("jacks" and "screws") due to the delayed detection by the shape sensor. Accordingly, the known strip shape control method suffers from delayed control of the strip shape in response to the detected output of the shape sensor, leading to potential difficulty in assuring sufficiently high precision of the strip shape control. Further, since the method in question does not utilize a detected change in the rolling force, the method has a tendency of low response to the strip shape variation due to the change in the rolling force, which occurs when the rolling speed is changed. This problem is serious particularly in the case of rolling of an aluminum strip.

SUMMARY OF THE INVENTION

The present invention was developed in the light of the above problems experienced in the prior art. It is therefore an object of the present invention to provide a method of controlling the shape of a strip rolled by a rolling mill, with high precision and stability, and with improved response to the change in the strip shape, without an influence of delayed detection of the strip shape and delayed response of the shape correcting actuators.

The above object may be achieved according to the principle of the present invention, which provides a method of controlling a transverse shape of a strip rolled by a rolling mill having a pair of work rolls, equipped with a plurality of shape correcting devices for correcting the shape of the rolled strip in the direction of width thereof, the shape correcting devices associated with the work rolls, the devices including a tilt adjusting device, a work roll bending force adjusting device, and a bending force differential adjusting device, the method comprising the steps of: (a) detecting a change in a rolling force acting on the strip; (b) detecting a tension distribution of the rolled strip in said direction of width of the strip, immediately after the rolling of the strip; (c) calculating a strain distribution of the rolled strip in said direction of width, on the basis of the detected tension distribution; (d) calculating from the calculated strain distribution, a shape parameter which represents a shape error of the rolled strip; (f) estimating, on the basis of the detected change in the rolling force and the calculated shape parameter, external disturbance values of the rolling mill which should be zeroed by the shape correcting devices, the disturbance values being estimated so as to offset a delay in the detection of the tension distribution which is reflected on the shape parameter; and (g) controlling the shape correcting devices, according to the calculated disturbance values, without an influence of the delay in the detection of the tension distribution.

The present invention is also applicable to the rolling mill equipped with another bending force adjusting device provided as one of the shape correcting device, for adjusting the bending force applied to a pair of intermediate rolls between which the work rolls are disposed. In this case, the intermediate roll bending force adjusting device is also controlled according to the estimated disturbance values.

BRIEF DESCRIPTION OF THE DRAWINGS

The above and other objects, features and advantages of the present invention will be better understood by reading the following detailed description of the invention, when considered in connection with the accompanying drawings, in which.

DETAILED DESCRIPTION OF THE INVENTION

Figure 1:
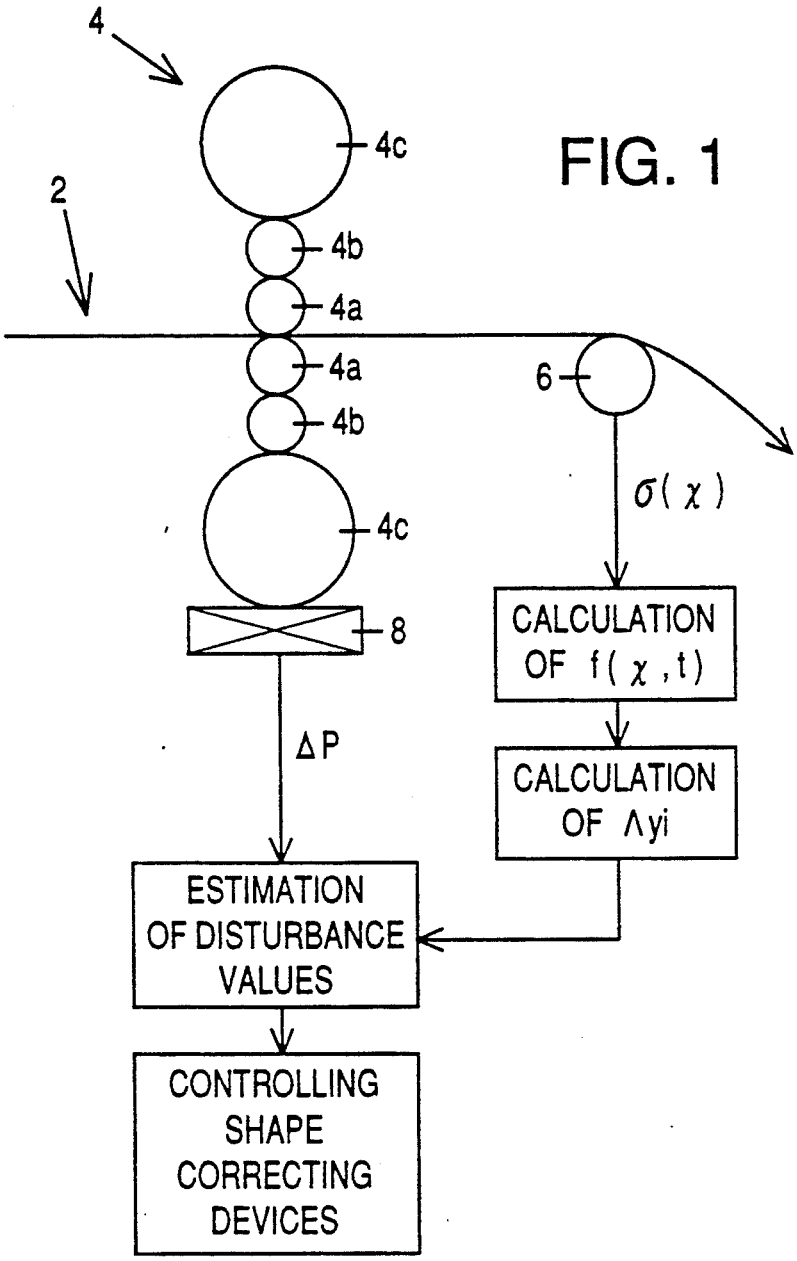
FIG. 1 is a schematic view showing an example of a rolling mill to which the present invention is applicable.

The principle of the present invention is schematically illustrated in FIG. 1, wherein reference numeral 4 denotes a rolling mill for rolling a metal strip 2. The tension of the strip 2 rolled by a pair of work rolls 4a is measured by a tension sensor roll 6 disposed downstream of the rolling station including the work rolls 4a, in the rolling direction. The tension sensor roll 6 includes a plurality of load cells for detecting the tension of the rolled strip 2, at respective transverse positions which are spaced from each other in the transverse or width direction perpendicular to the rolling direction. The output signals of these load cells of the tension sensor roll 6 collectively represent a transverse tension distribution $\sigma(x)$[x: transverse position] of the rolled strip, which reflects the shape of the rolled strip 2 in the transverse or width direction.

In the rolling mill as shown in FIG. 1, the work rolls 4a, 4a at the rolling station define a roll gap through which the strip 2 is passed for rolling. The rolling station further includes a pair of intermediate rolls 4b, 4b, and a pair of back-up rolls 4c, 4c. Each intermediate roll 4b is interposed between the corresponding work and back-up rolls 4a, 4c. Thus, the rolling station has a total of six rolls. However, the rolling station may consist of a total of four rolls, without the intermediate rolls 4b, as well known in the art. The rolling mill is equipped with plurality of shape correcting devices such as roll tilt adjusting device, work roll bending force adjusting device, work roll bending force differential adjusting device, and intermediate roll bending force adjusting device, which are well known in the art. These shape correcting devices include suitable actuators such as hydraulic cylinders, which are suitably controlled so as to correct or control the shape of the rolled strip in the width direction, namely, the transverse shape distribution. The rolling mill 4 is further equipped with a load cell 8 for detecting an amount of change $\Delta P$ in a rolling force P which acts on the strip 2 in the direction of thickness of the strip, in which the rolls 4a, 4b, 4c are arranged.

On the basis of the transverse tension distribution $\sigma(x)$ of the rolled strip 2 detected by the tension sensor roll 6, a transverse strain distribution f(x,t) of the rolled strip 2 in the width direction is calculated according to the following equation (a):

$$f(x, t-\tau) = \frac{1}{E}\left[\sigma(x) - \sigma^{ref}(x)\right] \quad \text{(a)}$$

where, f(x,t): transverse strain distribution of the strip 2 immediately after the rolling (error from a desired strain value)

t: time x: transverse position of the rolled strip 2

$\tau$: time delay of the output of the sensor roll 6

$\sigma^{ref}(x)$: desired transverse tension distribution

E: Young's modulus of the strip 2

On the basis of the calculated value $f(x,t-\tau)$, a shape parameter $\Lambda yi$ (i=1, . . . , n) of the rolled strip 2 is calculated, where "n" represents the number of the shape correcting devices. This shape parameter $\Lambda yi$ represents a shape error of the rolled strip 2. Where i=4, for example, the value "y" is calculated by the following equation (b):

$$y = \Lambda y1J1(x) + \Lambda y2J2(x) + \Lambda y3J3(x) + \Lambda y4J4(x) \quad (b)$$

The shape parameter $\Lambda yi$ is selected so that the calculated value "y" is closest or nearest to the value $f(x,t-\tau)$. In the above equation (b), values Ji(x) are arbitrary different functions. Where the values Ji(x) are orthogonal functions, for example, the shape parameter $\Lambda yi$ is expressed by the following equation (c):

$$\Lambda_{yi} = \int_{-w/2}^{w/2} f(x, t-\tau)J_i(x)dx \quad \text{(c)}$$

where, W: width of the strip 2.

The shape parameter $\Lambda yi$ is selected so that a value represented by the following equation (d) is the smallest, so that the value "y" is nearest to the value $f(x, t-\tau)$:

$$\int_{-w/2}^{w/2} [f(x, t-\tau) - y]^2 dx \quad \text{(d)}$$

The thus obtained shape parameter $\Lambda yi$ and the amount of change $\Delta P$ in the rolling force P detected by the load cell 8 are used to estimate disturbance values of the rolling mill 4, which cause the shape error of the rolled strip 2. These disturbance values include: disturbance $d_L$ that should be eliminated by adjusting the tilting angle of the work rolls 4a, 4a; disturbance $d_{WR}$ that should be eliminated by adjusting the bending force applied to the work rolls 4a, 4a; disturbance $d_{WRD}$ that should be eliminated by adjusting the difference between the bending force values as measured at both ends of the work rolls 4a, 4a; and disturbance $d_{IMR}$ that should be eliminated by adjusting the bending force applied to the intermediate rolls 4b, 4b. In estimating these disturbance values $d_L$, $d_{WR}$, $d_{WRD}$, $d_{IMMR}$, the detection delay of the tension sensor roll 6 which is reflected on the shape parameter $\Lambda yi$ is offset or compensated for.

According to the thus estimated disturbance values, the actuators of the shape correcting devices are operated. More specifically, the disturbance $d_L$ is eliminated or zeroed by adjusting the angle of tilting of the work rolls 4a, 4a, and the disturbances $d_{WR}$ and $d_{IMR}$ are zeroed by adjusting the bending forces applied to the work and intermediate rolls 4a, 4b. Further, the disturbance $d_{WRD}$ is zeroed by adjusting the bending force difference at the opposite ends of the work rolls 4a. The actuators are controlled in the feedback fashion, according to the disturbance values estimated from time to time, so as to compensate the operation amounts of the actuators for the delayed detection of the tension sensor roll 6.

The estimation of the disturbance values and the control of the actuators are effected according to the following equations (e):

$$\frac{d}{dt} z = A_c \cdot z + A_{cd} \cdot z(t-\tau) + B_c \cdot y + B_{cd} y_d \quad \text{(e)}$$

$$u = C_c \cdot z + D_c \cdot y$$

$$z = (\Delta \hat{S}_L^c, \hat{d}_L, \Delta \hat{F}^c_{WRD}, \hat{d}_{WRD}, \Delta \hat{F}^c_{WR}, \hat{d}_{WR}, \Delta \hat{F}^c_{IMR}, \hat{d}_{IMR})^T$$

$$y = (\Lambda_{y1}, \Lambda_{y2}, \Lambda_{y3}, \Lambda_{y4}, \Delta P)^T$$

$$y_d = \Delta P(t-\tau)$$

$$u = (\Delta S_L^{ref}, \Delta F^{ref}_{WRD}, \Delta F^{ref}_{WR}, \Delta F^{ref}_{IMR})^T$$

In the case where the bending force applied to the intermediate rolls 4b is not adjusted, a value $\Delta F_{IMR}{}^{ref}$ in the above equation (e) is not produced. The meanings of values Ac, Acd, Bc, Bcd, Cc, Dc, etc. in the above equations (e) will be understood by the following description.

There will be described in detail the method of controlling the shape of the rolled strip 2, according to the present invention. The following equation (1) represents shape variations of the strip 2 rolled by the 6-roll rolling station of the rolling mill 4 shown in FIG. 1:

$$\begin{bmatrix} \Lambda_1 \\ \Lambda_2 \\ \Lambda_3 \\ \Lambda_4 \end{bmatrix} = \begin{bmatrix} K_{11}K_{12}K_{13}K_{14} \\ K_{21}K_{22}K_{23}K_{24} \\ K_{31}K_{32}K_{33}K_{34} \\ K_{41}K_{42}K_{43}K_{44} \end{bmatrix} \begin{bmatrix} \Delta S_L \\ \Delta F_{WR} \\ \Delta F_{WRD} \\ \Delta F_{1MR} \end{bmatrix} + \begin{bmatrix} K_{p1} \\ K_{p2} \\ K_{p3} \\ K_{p4} \end{bmatrix} \Delta P \quad (1)$$

where, $$f(x, t) = \Lambda_1 \cdot J_1(x) + \Lambda_2 \cdot J_2(x) + \Lambda_3 \cdot J_3(x) + \Lambda_4 \cdot J_4(x) + \epsilon_r(x, t) \quad (2)$$

f(x,t): transverse strain distribution of the rolled strip 2 (error from a desired strain value)

x: transverse position of the strip 2 (x=0: center in the transverse or width direction)

t: time

Ji(x): arbitrary functions (i: number of the shape correcting devices), which are expressed by the following equations (3), for example:

$$\left.\begin{aligned} J_1(x) &= x \\ J_2(x) &= (3x^2 - 1)/2 \\ J_3(x) &= (5x^3 - 3x)/2 \\ J_4(x) &= (35x^4 - 30x^2 + 3)/8 \end{aligned}\right\} \quad (3)$$

$\epsilon r(x,t)$: component not expressed by a linear connection of Ji(x) in f(x,t)

$\Delta P$: amount of change in the rolling force $\Delta S_L$: error in tilting angle of the work rolls 4a (error in difference between roll gaps at both ends of the work rolls 4a, from a desired or optimum value)

$\Delta F_{WR}$: error in bending force of the work rolls 4a, from a desired or optimum value $\Delta F_{WRD}$: error in difference between bending forces at both ends of the work rolls 4a, from a desired or optimum value $\Delta F_{IMR}$: error in bending force of the intermediate rolls 4b, from a desired or optimum value Kij, Kpj: constants (determined by the width and material of the strip 2, etc.)

The above equation (1) applies to the 6-roll rolling stand of the rolling mill 4 of FIG. 1, and the four errors $\Delta S_L$, $\Delta F_{WR}$, $\Delta F_{WRD}$ and $\Delta F_{IMR}$ expressed by the following equations (4) through (7) are applicable:

$$\Delta S\,L = \Delta S\,L^c + d\,L \quad (4)$$

$$\Delta F\,WR = \Delta F\,WR^c + d\,WR \quad (5)$$

$$\Delta F\,WRD = \Delta F\,WRD^c + d\,WRD \quad (6)$$

$$\Delta F\,IMR = \Delta F\,IMR^c + d\,IMR \quad (7)$$

where, $\Delta S_L{}^c$: amount of change in the tilting angle $d_L$: disturbance eliminated by $\Delta S_L{}^c$ $\Delta F_{WR}{}^c$: amount of change in the work roll bending force $d_{WR}$: disturbance eliminated by $\Delta F_{WR}{}^c$ $\Delta F_{WRD}{}^c$: amount of change in the work roll bending force difference $d_{WRD}$: disturbance eliminated by $\Delta F_{WRD}{}^c$ $\Delta F_{IMR}{}^c$: amount of change in the work roll bending force difference $d_{IMR}$: disturbance eliminated by $\Delta F_{IMR}{}^c$ The above disturbances $d_L$, $d_{WR}$, $d_{WRD}$ and $d_{IMR}$ are caused by thermal expansion of the rolls 4a, 4b, 4c. Response characteristics of control of the shape correcting devices for adjustments of the work roll tilting angle, work roll bending force, work roll bending force difference and intermediate roll bending force, can be approximated by a first-order time lag, as expressed by the following equations (8) through (11):

$$T_L \frac{d}{dt} \Delta S_L{}^c = -\Delta S_L{}^c + \Delta S_L^{ref} \quad (8)$$

$$T_{WR} \frac{d}{dt} \Delta F^c_{WR} = -\Delta F^c_{WR} + \Delta F^{ref}_{WR} \quad (9)$$

$$T_{WRD} \frac{d}{dt} \Delta F^c_{WRD} = -\Delta F^c_{WRD} + \Delta F^{ref}_{WRD} \quad (10)$$

$$T_{1MR} \frac{d}{dt} \Delta F^c_{IMR} = -\Delta F^c_{IMR} + \Delta F^{ref}_{IMR} \quad (11)$$

where, $\Delta S_L{}^{ref}$: commanded amount of change in the tilting angle $\Delta F_{WR}{}^{ref}$: commanded amount of change in the work roll bending force $\Delta F_{WRD}{}^{ref}$: commanded amount of change in the work roll bending force difference $\Delta F_{IMR}{}^{ref}$: commanded amount of change in the intermediate roll bending force Suppose the time lag of the shape parameter $\Lambda yi$ (due to the detection delay of the tension sensor roll 6) is represented by $\tau(S)$, the following equations (12) through (15) are obtained, with respect to the detectable shape parameters $\Lambda yi$:

$$\Lambda y1 = \Lambda 1\,(t-\tau) \quad (12)$$

$$\Lambda y2=\Lambda 2(t-\tau) \quad (13)$$

$$\Lambda y3=\Lambda 3(t-\tau) \quad (14)$$

$$\Lambda y4=\Lambda 4\ (t-\tau) \quad (15)$$

Suppose orthogonal polynominals as expressed by. the above equation (3) are used for Ji(x), the shape parameter Λyi is obtained from the detected strain f(x, t−τ), according to the following equation (16):

$$\Lambda_{yi} = \int_{-w/2}^{w/2} f(x, t-\tau)J_i(x)dx \quad (16)$$

where, W: width of the strip 2.

Figure 2:
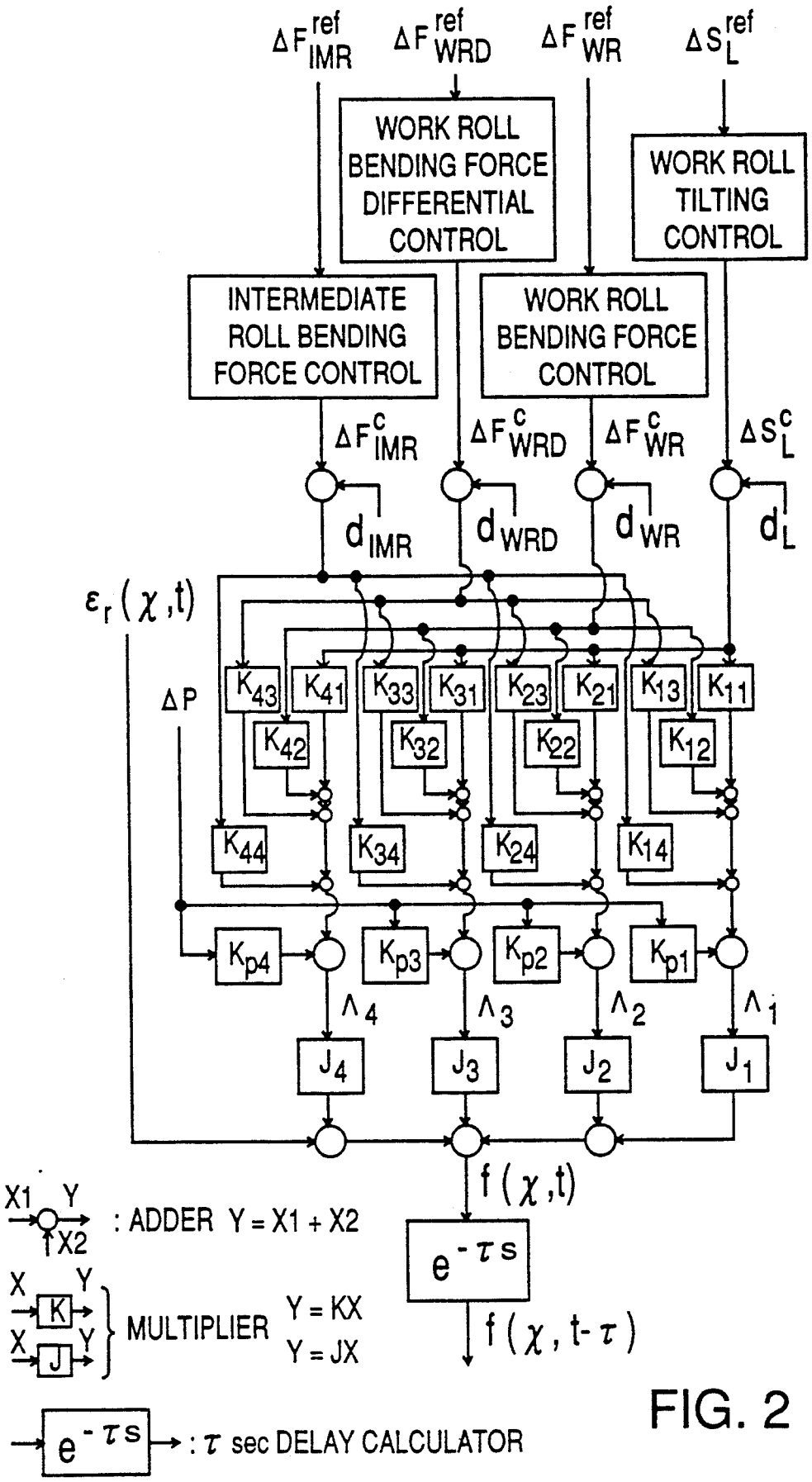
FIG. 2 is a block diagram illustrating a method of controlling the strip shape according to one embodiment of the present invention.

The above equations (1) through (11), which are mathematical formulas relating to the subjects to be controlled, are represented by the diagram in FIG. 2.

Objects to be achieved with respect to the subjects to be controlled for controlling the shape of the rolled strip 2 are generally expressed by the following equations (17) and (18):

$$\Lambda i=0\ (i=1\sim 4) \quad (17)$$

$$\epsilon r\ (\chi, t)=0 \quad (18)$$

The objects according to the above equation (17) are achieved by changing the tilting angle of the work rolls 4*a*, bending forces of the work and intermediate rolls 4*a*, 4*b* and bending force difference of the intermediate rolls 4*b*, namely, achieved by the commanded amounts of change $\Delta S_L^{ref}$, $\Delta F_{WR}^{ref}$, $\Delta F_{WRD}^{ref}$, and $\Delta F_{IMR}^{ref}$.

Described more particularly, the commanded amounts of change $\Delta S_L^{ref}$, $\Delta F_{WR}^{ref}$, $\Delta F_{WRD}^{ref}$, and $\Delta F_{IMR}^{ref}$ are obtained according to the following equations (19) through. (22), for adjusting the response characteristics of the amounts of change $\Delta S_L^c$, $\Delta F_{WR}^c$, $\Delta F_{WRD}^c$ and $\Delta F_{IMR}^c$:

$$\Delta S_L^{ref} = \left(1 - \frac{T_L}{T_L}\right)\Delta S_L^c + \frac{T_L}{T_L}\Delta\tilde{S}_L^{ref} \quad (19)$$

$$\Delta F_{WR}^{ref} = \left(1 - \frac{T_{WR}}{T_{WR}}\right)\Delta F_{WR}^c + \frac{T_{WR}}{T_{WR}}\Delta\tilde{F}_{WR}^{ref} \quad (20)$$

$$\Delta F_{WRD}^{ref} = \left(1 - \frac{T_{WRD}}{T_{WRD}}\right)\Delta F_{WRD}^c + \frac{T_{WRD}}{T_{WRD}}\Delta\tilde{F}_{WRD}^{ref} \quad (21)$$

$$\Delta F_{IMR}^{ref} = \left(1 - \frac{T_{IMR}}{T'_{IMR}}\right)\Delta F_{IMR}^c + \frac{T_{IMR}}{T_{IMR}}\Delta\tilde{F}_{IMR}^{ref} \quad (22)$$

$T'_L$, $T'_{WR}$, $T'_{WRD}$ and $T'_{IMR}$ are time constants after the adjustments of the response characteristics, and $\Delta\tilde{S}_L^{ref}$, $\Delta\tilde{F}_{WR}^{ref}$, $\Delta\tilde{F}_{WRD}^{ref}$ and $\Delta\tilde{F}_{IMR}^{ref}$ are new or updated command values for operating the respective shape correcting devices.

To zero the disturbances of the rolling mill 4, so as to achieve the control objects, namely, satisfy the above equation (17), feed-forward controls of the shape correcting devices are effected according to the following equations (23) through (26):

$$\Delta\tilde{S}_L^{ref}=-d\ L-K'p1\Delta P \quad (23)$$

$$\Delta\tilde{F}_{WR}^{ref}=-d\ WR-K'p2\Delta P \quad (24)$$

$$\Delta\tilde{F}_{WRD}^{ref}=-d\ WRD-K'p3\Delta P \quad (25)$$

$$\Delta\tilde{F}_{IMR}^{ref}=-d\ IMR-K'p4\Delta P \quad (26)$$

where, K'p1, K'p2, K'p3 and K'p4 are expressed by the following equations (27) and (28):

$$\begin{bmatrix} K'_{p1} \\ K'_{p2} \\ K'_{p3} \\ K'_{p4} \end{bmatrix} = \begin{bmatrix} K'_{11}K'_{12}K'_{13}K'_{14} \\ K'_{21}K'_{22}K'_{23}K'_{24} \\ K'_{31}K'_{32}K'_{33}K'_{34} \\ K'_{41}K'_{42}K'_{43}K'_{44} \end{bmatrix} \begin{bmatrix} K_{p1} \\ K_{p2} \\ K_{p3} \\ K_{p4} \end{bmatrix} \quad (27)$$

$$\begin{bmatrix} K'_{11}K'_{12}K'_{13}K'_{14} \\ K'_{21}K'_{22}K'_{23}K'_{24} \\ K'_{31}K'_{32}K'_{33}K'_{34} \\ K'_{41}K'_{42}K'_{43}K'_{44} \end{bmatrix} = \begin{bmatrix} K_{11}K_{12}K_{13}K_{14} \\ K_{21}K_{22}K_{23}K_{24} \\ K_{31}K_{32}K_{33}K_{34} \\ K_{41}K_{42}K_{43}K_{44} \end{bmatrix}^{-1} \quad (28)$$

Based on the above equations (19) through (26), the amounts of operation of the shape correcting devices are given according to the following equations (29) through (32):

$$\Delta S_L^{ref} = \left(1 - \frac{T_L}{T_L}\right)\Delta S_L^c - \frac{T_L}{T_L}(d_L + K'_{p1}\Delta P) \quad (29)$$

$$\Delta F_{WR}^{ref} = \left(1 - \frac{T_{WR}}{T_{WR}}\right)\Delta F_{WR}^c + \frac{T_{WR}}{T_{WR}}(d_{WR} + K'_{p2}\Delta P) \quad (30)$$

$$\Delta F_{WRD}^{ref} = \left(1 - \frac{T_{WRD}}{T_{WRD}}\right)\Delta F_{WRD}^c + \frac{T_{WRD}}{T_{WRD}}(d_{WRD} + K'_{p3}\Delta P) \quad (31)$$

$$\Delta F_{IMR}^{ref} = \left(1 - \frac{T_{IMR}}{T_{IMR}}\right)\Delta F_{IMR}^c + \frac{T_{IMR}}{T_{IMR}}(d_{IMR} + K'_{p4}\Delta P) \quad (32)$$

To solve the above equations (29) through (32), the disturbance values $d_L$, $d_{WR}$, $d_{WRD}$ and $d_{IMP}$ should be known. There will be described the manner in whch these disturbance values are estimated by respective estimators or observers.

First, the following basic mathematical formulas (33) through (36) are considered:

$$\frac{d}{dt}d_L = 0 \quad (33)$$

$$\frac{d}{dt}d_{WR} = 0 \quad (34)$$

$$\frac{d}{dt}d_{WRD} = 0 \quad (35)$$

$$\frac{d}{dt}d_{IMR} = 0 \quad (36)$$

a) Observer for estimating $d_L$, $\Delta S_L^c$

From the first line of the above equation (1), and the above equations (4), (8), (29) and (33), this observer can be constituted as expressed by the following equations (37) , (38) and (39):

$$\frac{d}{dt}\begin{bmatrix}\Delta\hat{S}_L{}^c\\ \hat{d}_L\end{bmatrix}=\begin{bmatrix}-1/T_{L0} & 0\\ 0 & 0\end{bmatrix}\begin{bmatrix}\Delta\hat{S}_L{}^c\\ \hat{d}_L\end{bmatrix}+\begin{bmatrix}0\\ K_L\end{bmatrix}\epsilon_L+\begin{bmatrix}1/T_L\\ 0\end{bmatrix}\Delta S_L^{ref} \tag{37}$$

$$\epsilon_L=(K'_{11}\Lambda_1+K'_{12}\Lambda_2+K'_{13}\Lambda_3+K'_{14}\Lambda_4)-(\Delta\hat{S}_L{}^c+\hat{d}_L)-K'_{p1}\Delta P \tag{38}$$

$$\Delta S_L^{ref}=(1-T_L/T'_L)\Delta\hat{S}_L{}^c-T_L/T'_L(\hat{d}_L+K'_{p1}\Delta P) \tag{39}$$

It is noted that $\Delta\hat{S}_L{}^c$ and $\hat{d}_L$ are estimated values of $\Delta S_L{}^c$ and $d_L$, while $\epsilon L$ is an estimated error. If the estimated values are correct, the estimated error $\epsilon L$ is equal to zero, as is apparent from the following equation (42). $K_L$in the above equation (37) is a gain of the observer. From the equations (4)–(7), the following equation (40) is obtained:

$$\begin{bmatrix}\Lambda_1\\ \Lambda_2\\ \Lambda_3\\ \Lambda_4\end{bmatrix}=\begin{bmatrix}K_{11}K_{12}K_{13}K_{14}\\ K_{21}K_{22}K_{23}K_{24}\\ K_{31}K_{32}K_{33}K_{34}\\ K_{41}K_{42}K_{43}K_{44}\end{bmatrix}\begin{bmatrix}\Delta S_L{}^c+d_L\\ \Delta F^c_{WR}+d_{WR}\\ \Delta F^c_{WRD}+d_{WRD}\\ \Delta F^c_{IMR}+d_{IMR}\end{bmatrix}+\begin{bmatrix}K_{p1}\\ K_{p2}\\ K_{p3}\\ K_{p4}\end{bmatrix}\Delta P \tag{40}$$

From the above equations (27) and (28), the following equation (41) is obtained:

$$\begin{bmatrix}K'_{11}K'_{12}K'_{13}K'_{14}\\ K'_{21}K'_{22}K'_{23}K'_{24}\\ K'_{31}K'_{32}K'_{33}K'_{34}\\ K'_{41}K'_{42}K'_{43}K'_{44}\end{bmatrix}\begin{bmatrix}\Lambda_1\\ \Lambda_2\\ \Lambda_3\\ \Lambda_4\end{bmatrix}=\begin{bmatrix}\Delta S_L{}^c+d_L\\ \Delta F^c_{WR}+d_{WR}\\ \Delta F^c_{WRD}+d_{WRD}\\ \Delta F^c_{IMR}+d_{IMR}\end{bmatrix}+\begin{bmatrix}K'_{p1}\\ K'_{p2}\\ K'_{p3}\\ K'_{p4}\end{bmatrix}\Delta P \tag{41}$$

Therefore, the following equation (42) is obtained:

$$\begin{bmatrix}K'_{11}K'_{12}K'_{13}K'_{14}\\ K'_{21}K'_{22}K'_{23}K'_{24}\\ K'_{31}K'_{32}K'_{33}K'_{34}\\ K'_{41}K'_{42}K'_{43}K'_{44}\end{bmatrix}\begin{bmatrix}\Lambda_1\\ \Lambda_2\\ \Lambda_3\\ \Lambda_4\end{bmatrix}-\begin{bmatrix}\Delta S_L{}^c+d_L\\ \Delta F^c_{WR}+d_{WR}\\ \Delta F^c_{WRD}+d_{WRD}\\ \Delta F^c_{IMR}+d_{IMR}\end{bmatrix}-\begin{bmatrix}K'_{p1}\\ K'_{p2}\\ K'_{p3}\\ K'_{p4}\end{bmatrix}\Delta P=0 \tag{42}$$

From the above equations (37), (38) and (39), the following equation (43) can be obtained:

$$\frac{d}{dt}\begin{bmatrix}\Delta\hat{S}_L{}^c\\ \hat{d}_L\end{bmatrix}=\begin{bmatrix}-1/T'_L & -1/T_L\\ -K_L & -K_L\end{bmatrix}\begin{bmatrix}\Delta\hat{S}_L{}^c\\ \hat{d}_L\end{bmatrix}+\begin{bmatrix}0\\ K_L\end{bmatrix}\{(K'_{11}\Lambda_1+K'_{12}\Lambda_2+K'_{13}\Lambda_3+K'_{14}\Lambda_4)-K'_{p1}\Delta P\}+\begin{bmatrix}-K'_{p1}/T'_L\\ 0\end{bmatrix}\Delta P \tag{43}$$

Since the value $\Lambda i$ cannot be actually measured the shape parameter $\Lambda yi$ is calculated as described below.

The above equation (43) is first converted into the following equation (44):

$$\frac{d}{dt}\begin{bmatrix}\Delta\hat{S}_L{}^c\\ \hat{d}_L\end{bmatrix}=\begin{bmatrix}-1/T'_L & -1/T_L\\ -K_L & -K_L\end{bmatrix}\begin{bmatrix}\Delta\hat{S}_L{}^c\\ \hat{d}_L\end{bmatrix}+\begin{bmatrix}0\\ K_L\end{bmatrix}\left\{\sum_{j=1}^{4}K'_{1j}\Lambda_{yj}-\sum_{j=1}^{4}K'_{1j}\Lambda_{yj}+\sum_{j=1}^{4}K'_{1j}\Lambda_j-K'_{p1}\Delta P\right\}+\begin{bmatrix}-K'_{p1}/T'_L\\ 0\end{bmatrix}\Delta P \tag{44}$$

Suppose the values $\Delta S_L{}^c$ and $d_L$ are correctly estimated, the following equation (45) can be obtained from the above equation (41):

$$-\sum_{j=1}^{4}K'_{1j}\Lambda_{yj}+\sum_{j=1}^{4}K'_{1j}\Lambda_j=(1-e^{-\tau s})(\Delta\hat{S}_L{}^c+\hat{d}_L+K'_{p1}\Delta P) \tag{45}$$

Therefore, the above equation (44) can be expressed as the following equation (46):

$$\frac{d}{dt}\begin{bmatrix}\Delta\hat{S}_L{}^c\\ \hat{d}_L\end{bmatrix}=\begin{bmatrix}-1/T'_L & -1/T_L\\ 0 & 0\end{bmatrix}\begin{bmatrix}\Delta\hat{S}_L{}^c\\ \hat{d}_L\end{bmatrix}+\begin{bmatrix}0\\ K_L\end{bmatrix}(K'_{11}\Lambda_{y1}+K'_{12}\Lambda_{y2}+K'_{13}\Lambda_{y3}+K'_{14}\Lambda_{y4})+\begin{bmatrix}0\\ K_L\end{bmatrix}(-e^{-\tau s})(\Delta\hat{S}_L{}^c+\hat{d}_L+K'_{p1}\Delta P)+\begin{bmatrix}-K'_{p1}/T'_L\\ 0\end{bmatrix}\Delta P \tag{46}$$

The thus obtained equations (39) and (46) give the operation amount $\Delta S_L{}^{ref}$ of the device for adjusting the tilting angle of the work rolls 4*a*.

b) Observer for estimating $d_{WRD}$, $\Delta S_{WRD}{}^c$

From the above equations (1), (6), (10), (31) and (35), this observer can be constituted as expressed by the following equations (47), (48) and (49):

$$\frac{d}{dt}\begin{bmatrix}\Delta\hat{F}^c_{WRD}\\ \hat{d}_{WRD}\end{bmatrix}=\begin{bmatrix}-1/T_{WRD0} & 0\\ 0 & 0\end{bmatrix}\begin{bmatrix}\Delta\hat{F}^c_{WRD}\\ \hat{d}_{WRD}\end{bmatrix}+ \tag{47}$$

-continued $$\begin{bmatrix} 0 \\ K_{WRD} \end{bmatrix} \epsilon_{WRD} + \begin{bmatrix} 1/T_{WRD} \\ 0 \end{bmatrix} \Delta F^{ref}_{WRD}$$

$$\epsilon_{WRD} = (K'_{31}\Lambda_1 + K'_{32}\Lambda_2 + K'_{33}\Lambda_3 + K'_{34}\Lambda_4) - (\Delta\hat{F}^c_{WRD} + \hat{d}_{WRD}) - K'_{p3}\Delta P \quad (48)$$

$$\Delta F^{ref}_{WRD} = (1 - T_{WRD}/T'_{WRD})\Delta\hat{F}^c_{WRD} - T_{WRD}/T'_{WRD}(\hat{d}_{WRD} + K'_{p3}\Delta P) \quad (49)$$

It is noted that $\Delta\hat{F}_{WRD}{}^c$ and $\hat{d}_{WRD}$ are estimated values of $\Delta F_{WRD}{}^c$ and $d_{WRD}$, while $\epsilon$WRD is an estimated error. If the estimated values are correct, the estimated error $\epsilon$WRD is equal to zero, as is apparent from the above equation (42) $k_{WRD}$ in the above equation (47) is a gain of the observer. From the equations (47) through (49), the following equation (50) is obtained:

$$\frac{d}{dt}\begin{bmatrix} \Delta\hat{F}^c_{WRD} \\ \hat{d}_{WRD} \end{bmatrix} = \begin{bmatrix} -1/T'_{WRD} & -1/T'_{WRD} \\ -K_{WRD} & -K_{WRD} \end{bmatrix}\begin{bmatrix} \Delta\hat{F}^c_{WRD} \\ \hat{d}_{WRD} \end{bmatrix} + \begin{bmatrix} 0 \\ K_{WRD} \end{bmatrix}\left(\sum_{j=1}^{4} K'_{3j}\Lambda_{yj} - \sum_{j=1}^{4} K'_{3j}\Lambda_{yj} + \sum_{j=1}^{4} K'_{3j}\Lambda_j - K'_{p3}\Delta P\right) + \begin{bmatrix} -K'_{p3}/T'_{WRD} \\ 0 \end{bmatrix}\Delta P \quad (50)$$

From the above equation (41), the following equation (51) is obtained:

$$-\sum_{j=1}^{4} K'_{3j}\Lambda_{yj} + \sum_{j=1}^{4} K'_{3j}\Lambda_j = (1 - e^{-\tau s})(\Delta\hat{F}^c_{WRD} + \hat{d}_{WRD} + K'_{p3}\Delta P) \quad (51)$$

Hence, $$\frac{d}{dt}\begin{bmatrix} \Delta F^c_{WRD} \\ d_{WRD} \end{bmatrix} = \begin{bmatrix} -1/T_{WRD} & -1/T'_{WRD} \\ 0 & 0 \end{bmatrix}\begin{bmatrix} \Delta F^c_{WRD} \\ d_{WRD} \end{bmatrix} + \begin{bmatrix} 0 \\ K_{WRD} \end{bmatrix}\left(\sum_{j=1}^{4} K'_{3j} - e^{-\tau s}(\Delta F^c_{WRD} + d_{WRD} + K'_{p3}\Delta P)\right) + \begin{bmatrix} -K'_{P3}/T'_{WRD} \\ 0 \end{bmatrix}\Delta P$$

The thus obtained equations (49) and (51) give the operation amount $\Delta F_{WRD}{}^{ref}$ of the device for adjusting the bending force difference of the work rolls 4a.

c) Observer for estimating $d_{WR}$, $\Delta S_{WR}{}^c$

From the above equations (1), (5), (9), (30) and (34), this observer can be constituted as expressed by the following equations (52), (53) and (54):

$$\frac{d}{dt}\begin{bmatrix} \Delta\hat{F}^c_{WR} \\ \hat{d}_{WR} \end{bmatrix} = \begin{bmatrix} -1/T_{WR} & 0 \\ 0 & 0 \end{bmatrix}\begin{bmatrix} \Delta\hat{F}^c_{WR} \\ \hat{d}_{RW} \end{bmatrix} + \begin{bmatrix} 0 \\ K_{WR} \end{bmatrix} \epsilon_{WR} + \begin{bmatrix} 1/T_{WR} \\ 0 \end{bmatrix}\Delta F^{ref}_{WR} \quad (52)$$

-continued $$\epsilon_{WR} = (K'_{21}\Lambda_1 + K'_{22}\Lambda_2 + K'_{23}\Lambda_3 + K'_{24}\Lambda_4) - K'_{p2}\Delta P - (\Delta\hat{F}^c_{WR} + \hat{d}_{WR}) \quad (53)$$

$$\Delta F^{ref}_{WR} = (1 - T_{WR}/T'_{WR})\Delta\hat{F}^c_{WR} - T_{WR}/T'_{WR}(\hat{d}_{WR} + K'_{P2}\Delta P) \quad (54)$$

It is noted that $\Delta\hat{F}_{WR}{}^c$ and $\hat{d}_{WR}$ are estimated values of $\Delta F_{WR}{}^c$ and $d_{WR}$, while $\epsilon$WR is an estimated error. If the estimated values are correct, the estimated error $\epsilon$WR is equal to zero. $K_{WR}$ in the above equation (47) is a gain of the observer. From the above equations (52), (53) and (54), the following equation (58) is obtained:

$$\frac{d}{dt}\begin{bmatrix} \Delta\hat{F}^c_{WR} \\ \hat{d}_{WR} \end{bmatrix} = \begin{bmatrix} -1/T'_{WR} & -1/T'_{WR} \\ -K_{WR} & -K_{WR} \end{bmatrix}\begin{bmatrix} \Delta\hat{F}^c_{WR} \\ \hat{d}_{WR} \end{bmatrix} + \begin{bmatrix} 0 \\ K_{WR} \end{bmatrix}\{(K'_{21}\Lambda_1 + K'_{22}\Lambda_2 + K'_{23}\Lambda_3 + K'_{24}\Lambda_4) - K'_{p2}\Delta P\} + \begin{bmatrix} -K'_{p2}/T'_{WR} \\ 0 \end{bmatrix}\Delta P \quad (58)$$

From the above equation (41), the following equation is obtained, if the values $\Delta F_{WR}{}^c$ and $d_{WR}$ are correctly estimated.

$$-\sum_{j=1}^{4} K'_{2j}\Lambda_{yj} + \sum_{j=1}^{4} K'_{2j}\Lambda_j = (1 - e^{-\tau s})(\Delta\hat{F}^c_{WR} + \hat{d}_{WR} + K'_{p2}\Delta P)$$

Therefore, the following equation (59) can be obtained:

$$\frac{d}{dt}\begin{bmatrix} \Delta\hat{F}^c_{WR} \\ \hat{d}_{WR} \end{bmatrix} = \begin{bmatrix} -1/T'_{WR} & -1/T'_{WR} \\ 0 & 0 \end{bmatrix}\begin{bmatrix} \Delta\hat{F}^c_{WR} \\ \hat{d}_{WR} \end{bmatrix} + \begin{bmatrix} 0 \\ K_{WR} \end{bmatrix}\left(\sum_{j=1}^{4} K'_{2j}\Lambda_{yj}\right) + \begin{bmatrix} 0 \\ K_{WR} \end{bmatrix}(-e^{-\tau s})(\Delta\hat{F}^c_{WR} + \hat{d}_{WR} + K'_{p2}\Delta P) + \begin{bmatrix} -K'_{p2}/T'_{WR} \\ 0 \end{bmatrix}\Delta P \quad (59)$$

The thus obtained equations (54) and (59) give the operation amount $\Delta F_{WR}{}^{ref}$ of the device for adjusting the bending force of the work rolls 4a.

d) Observer of estimating $d_{IMR}$, $\Delta S_{IMR}{}^c$

From the above equations (1), (7), (11), (32) and (36), this observer can be constituted as expressed by the following equations (60), (61) and (62):

$$\frac{d}{dt}\begin{bmatrix} \Delta\hat{F}^c_{IMR} \\ \hat{d}_{IMR} \end{bmatrix} = \begin{bmatrix} -1/T_{IMR} & 0 \\ 0 & 0 \end{bmatrix}\begin{bmatrix} \Delta\hat{F}^c_{IMR} \\ \hat{d}_{IMR} \end{bmatrix} + \quad (60)$$

-continued $$\begin{bmatrix} 0 \\ K_{IMR} \end{bmatrix} \epsilon_{IMR} + \begin{bmatrix} 1/T_{IMR} \\ 0 \end{bmatrix} \Delta F^{ref}_{IMR}$$

$$\epsilon_{IMR} = (K'_{41}\Lambda_1 + K'_{42}\Lambda_2 + K'_{43}\Lambda_3 + K'_{44}\Lambda_4) - K'_{p4}\Delta P - (\Delta\hat{F}^c_{IMR} + \hat{d}_{IMR}) \quad (61)$$

$$\Delta F^{ref}_{IMR} = (1 - T_{IMR}/T'_{IMR})\Delta\hat{F}^c_{IMR} - T_{IMR}/T'_{IMR}(\hat{d}_{IMR} + K'_{p4}\Delta P) \quad (62)$$

It is noted that $\Delta\hat{F}_{IMR}{}^c$ and $\hat{d}_{IMR}$ are estimated values of $\Delta F_{IMR}{}^c$ and $d_{IMR}$, while $\epsilon$IMR is an estimated error. If the estimated values are correct, the estimated error $\epsilon$IMR is equal to zero. $K_{IMR}$ in the above equation (60) is a gain of the observer. From the above equations (60), (61) and (62), the following equation (63) is obtained:

$$\frac{d}{dt}\begin{bmatrix} \Delta\hat{F}^c_{IMR} \\ \hat{d}_{IMR} \end{bmatrix} = \begin{bmatrix} -1/T'_{IMR} & -1/T'_{IMR} \\ -K_{IMR} & -K_{IMR} \end{bmatrix}\begin{bmatrix} \Delta\hat{F}^c_{IMR} \\ \hat{d}_{IMR} \end{bmatrix} + \begin{bmatrix} 0 \\ K_{IMR} \end{bmatrix}(K'_{41}\Lambda_1 + K'_{42}\Lambda_2 + K'_{43}\Lambda_3 + K'_{44}\Lambda_4) + \begin{bmatrix} -K'_{p4}/T'_{IMR} \\ -K_{IMR} \quad K'_{p4} \end{bmatrix}\Delta P \quad (63)$$

where, $$\sum_{j=1}^{4} K'_{4j}\Lambda_j = \sum_{j=1}^{4} K'_{4j}\Lambda_{yj} + (1 - e^{-\tau s})(\Delta\hat{F}^c_{IMR} + \hat{d}_{IMR} + K'_{p4}\Delta P)$$

From the above equation (63), the following equation (64) is obtained:

$$\frac{d}{dt}\begin{bmatrix} \Delta\hat{F}^c_{IMR} \\ \hat{d}_{IMR} \end{bmatrix} = \begin{bmatrix} -1/T'_{IMR} & -1/T'_{IMR} \\ 0 & 0 \end{bmatrix}\begin{bmatrix} \Delta\hat{F}^c_{IMR} \\ \hat{d}_{IMR} \end{bmatrix} + \begin{bmatrix} 0 \\ K_{IMR} \end{bmatrix}\left(\sum_{j=1}^{4} K'_{4j}\Lambda_{yj}\right) + \begin{bmatrix} 0 \\ K_{IMR} \end{bmatrix}(-e^{-\tau s})(\Delta\hat{F}^c_{IMR} + \hat{d}_{IMR} + K'_{p4}\Delta P) + \begin{bmatrix} -K'_{p4}/T'_{IMR} \\ 0 \end{bmatrix}\Delta P \quad (64)$$

The thus obtained equations (62) and (64) give the operation amount $\Delta F_{IMR}{}^{ref}$ of the device for adjusting the bending force of the intermediate rolls 4*b*.

It will be understood that the above equations (46), (51), (59) and (64) are the observers for estimating the disturbances of the rolling mill 4, and the equations (39), (49), (54) and (62) are the formulas for obtaining, on the basis of the estimated disturbances, the amounts by which the shape correcting devices are operated.

The above equations (39), (46), (49), (51), (54), (59), (62) and (64) are generally expressed by the above formulas (e), and the following equations representing Ac, Acd, Bcd, Bc, Dc and Cc:

$$\frac{d}{dt} z = A_c \cdot z + A_{cd} \cdot z(t - \tau) + B_c \cdot y + B_{cd}y_d$$

$$u = C_c \cdot z + D_c \cdot y$$

$$z = (\Delta\hat{S}_L{}^c, \hat{d}_L, \Delta\hat{F}^c_{WRD}, \hat{d}_{WRD}, \Delta\hat{F}^c_{WR}, \hat{d}_{WR}, \Delta\hat{F}_{IMR}, \hat{d}_{IMR})^T$$

$$y = (\Lambda_{y1}, \Lambda_{y2}, \Lambda_{y3}, \Lambda_{y4}, \Delta P)^T$$

$$y_d = \Delta P(t - \tau)$$

$$u = (\Delta S^{ref}_L, \Delta F^{ref}_{WRD}, \Delta F^{ref}_{WR}, \Delta F^{ref}_{IMR})^T$$

$$A_c = \begin{bmatrix} -1/T'_L & -1/T'_L & 0 & 0 & 0 & 0 & 0 & 0 \\ 0 & 0 & 0 & 0 & 0 & 0 & 0 & 0 \\ 0 & 0 & -1/T'_{WRD} & -1/T'_{WRD} & 0 & 0 & 0 & 0 \\ 0 & 0 & 0 & 0 & 0 & 0 & 0 & 0 \\ 0 & 0 & 0 & 0 & -1/T'_{WR} & -1/T'_{WR} & 0 & 0 \\ 0 & 0 & 0 & 0 & 0 & 0 & 0 & 0 \\ 0 & 0 & 0 & 0 & 0 & 0 & -1/T'_{IMR} & -1/T'_{IMR} \\ 0 & 0 & 0 & 0 & 0 & 0 & 0 & 0 \end{bmatrix}$$

$$A_{cd} = \begin{bmatrix} 0 & 0 & 0 & 0 & 0 & 0 & 0 & 0 \\ -K_L & -K_L & 0 & 0 & 0 & 0 & 0 & 0 \\ 0 & 0 & 0 & 0 & 0 & 0 & 0 & 0 \\ 0 & 0 & -K_{WRD} & -K_{WRD} & 0 & 0 & 0 & 0 \\ 0 & 0 & 0 & 0 & 0 & 0 & 0 & 0 \\ 0 & 0 & 0 & 0 & -K_{WR} & -K_{WR} & 0 & 0 \\ 0 & 0 & 0 & 0 & 0 & 0 & 0 & 0 \\ 0 & 0 & 0 & 0 & 0 & 0 & -K_{IMR} & -K_{IMR} \end{bmatrix}$$

-continued $$B_{cd} = \begin{bmatrix} 0 \\ -K'_{p1}K_L \\ 0 \\ -K'_{p3}K_{WRD} \\ 0 \\ -K'_{p2}K_{WR} \\ 0 \\ -K'_{p4}K_{IMR} \end{bmatrix}$$

$$B_c = \begin{bmatrix} 0 & 0 & 0 & 0 & -K'_{p1}/T_L \\ K_LK'_{11} & K_LK'_{12} & K_LK'_{13} & K_LK'_{14} & 0 \\ 0 & 0 & 0 & 0 & -K'_{p3}/T_{WRD} \\ K_{WRD}K'_{31} & K_{WRD}K'_{32} & K_{WRD}K'_{33} & K_{WRD}K'_{34} & 0 \\ 0 & 0 & 0 & 0 & -K'_{p2}/T_{WR} \\ K_{WR}K'_{21} & K_{WR}K'_{22} & K_{WR}K'_{23} & K_{WR}K'_{24} & 0 \\ 0 & 0 & 0 & 0 & -K'_{p4}/T_{IMR} \\ K_{IMR}K'_{41} & K_{IMR}K'_{42} & K_{IMR}K'_{43} & K_{IMR}K'_{44} & 0 \end{bmatrix}$$

$$D_c = \begin{bmatrix} 0 & 0 & 0 & 0 & -K'_{p1}T_L/T_L \\ 0 & 0 & 0 & 0 & -K'_{p3}T_{WRD}/T_{WRD} \\ 0 & 0 & 0 & 0 & -K'_{p2}T_{WR}/T_{WR} \\ 0 & 0 & 0 & 0 & -K'_{p4}T_{IMR}/T_{IMR} \end{bmatrix}$$

$$C_c = \begin{bmatrix} 1 - T_L/T_L & -T_L/T_L & 0 & 0 & 0 & 0 & 0 & 0 \\ 0 & 0 & 1 - T_{WRD}/T_{WRD} & -T_{WRD}/T_{WRD} & 0 & 0 & 0 & 0 \\ 0 & 0 & 0 & 0 & 1 - T_{WR}/T_{WR} & -T_{WR}/T_{WR} & 0 & 0 \\ 0 & 0 & 0 & 0 & 0 & 0 & 1 - T_{IMR}/T_{IMR} & -T_{IMR}/T_{IMR} \end{bmatrix}$$

Figure 3:
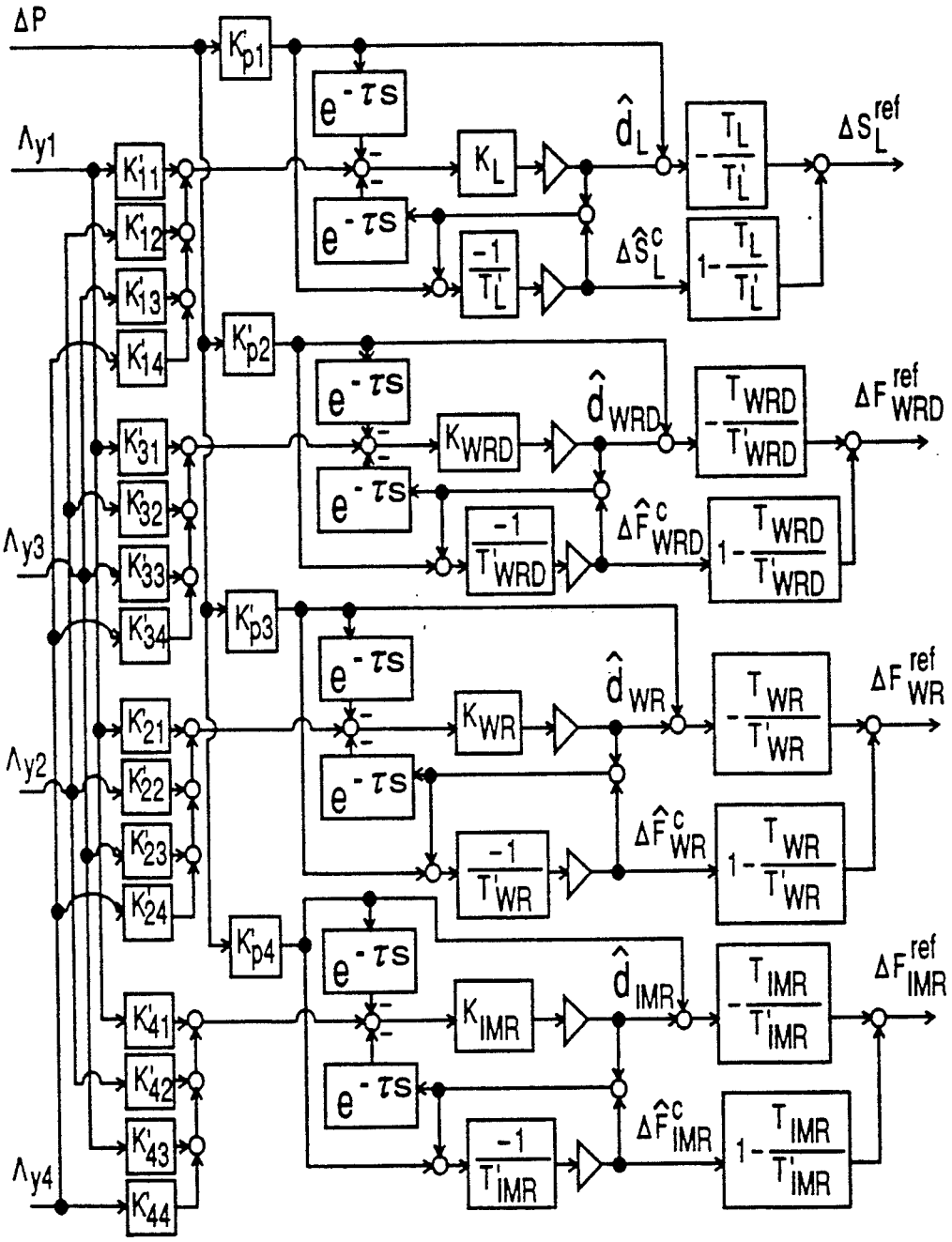
FIG. 3 is a block diagram illustrating a manner of estimating disturbance values so as to offset a delay in the detection of transverse tension distribution of the rolled strip.
Figure 3:
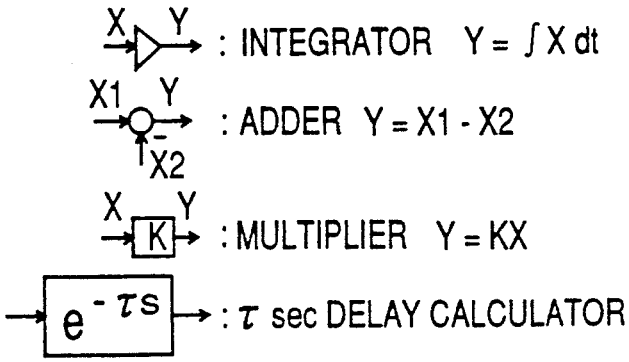

The components to obtain the operation amounts of the shape correcting devices from the calculated shape parameter Λyi and the detected amount of change ΔP of the rolling force are illustrated in the diagram of FIG. 3.

Figure 4:
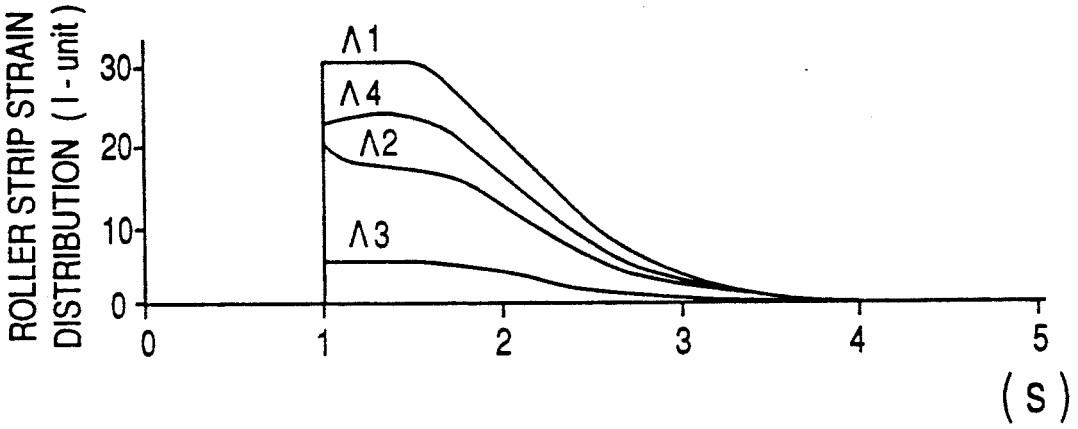
FIG. 4 is a graph showing a transverse strain distribution of the rolled strip 2 obtained by simulation.

To confirm the effect of controlling the shape of the rolled strip 2 as described above, simulation tests were conducted under the conditions indicated in TABLES 1, 2 and 3. Strain distribution (I-unit) of the rolled strips 2 obtained in the tests is indicated in the graph of FIG. 4. The graph shows that the influence of the disturbances on the shape variation of the rolled strip is effectively eliminated. TABLES 1 and 2 indicate standard parameters and gains of the observers, while TABLE 3 indicates the disturbances which occur at time 1(s).

It will be understood from the foregoing explanation that the strip shape control method according to the concept of the present invention permits high stability and response in controlling the shape distribution of the rolled strip, so as to offset the delay in the detection of the tension distribution by the tension sensor roll 6, which is used to calculate the strain distribution used to estimate the disturbances. The adjustment of the bending force difference at the opposite ends of the work rolls 4*a* is particularly effective to improve the shape control response, and the feed-forward control using the detected change in the rolling force assures high-precision control to deal with the shape variation of the rolled strip due to the rolling force variation upon acceleration and/or deceleration of the rolling speed. Further, the shape control system according to the present invention is relatively simple in construction and is easy to tune, and is free of mutual interferences among the actuators of the shape correcting devices.

While the present invention has been described above in the presently preferred embodiment, with a certain degree of particularity, it is to be understood that the invention is not limited to the details of the illustrated embodiment, but may be embodied with various changes, modifications and improvements, which may occur to those skilled in the art, in the light of the above teachings, without departing from the spirit and scope of the invention defined in the following claims.

What is claimed is:

1. A method of controlling a transverse shape of a strip rolled by a rolling mill having a pair of work rolls, equipped with a plurality of shape correcting devices for correcting the shape of the rolled strip in the direction of width thereof, said shape correcting devices being associated with said work rolls, said devices including a tilt adjusting device, a work roll bending force adjusting device, and a bending force differential adjusting device, said method comprising the steps of:

detecting a change in a rolling force acting on said strip;

detecting a tension distribution of the rolled strip in said direction of width of the strip, immediately after the rolling of the strip;

calculating a strain distribution of said rolled strip in said direction of width, on the basis of the detected tension distribution;

calculating from the calculated strain distribution, a shape parameter which represents a shape error of said rolled strip;

estimating, on the basis of the detected change in the rolling force and the calculated shape parameter, first, second and third disturbance values of said rolling mill which should be zeroed by said tilt adjusting device, said bending force differential adjusting device and said work roll bending force adjusting device, respectively, said first, second and third disturbance values being estimated according to the equation (46), (51) and (59) identified in the specification, respectively, so as to offset a delay in the detection of said tension distribution which is reflected on said shape parameter, each of said equations (46), (51) and (59) including a value for offsetting said delay in the detection of said tension distribution, and a value relating to a response characteristic of a corresponding one of said tilt adjusting device, said bending force differential adjusting device and said work roll bending force adjusting device; and controlling said shape correcting devices, according to the estimated first, second and third disturbance values, without an influence of said delay in the detection of said tension distribution.

2. A method according to claim 1, wherein said rolling mill further has a pair of intermediate rolls between which said work rolls are disposed, said shape correcting devices further including an intermediate roll bending force adjusting device associated with said intermediate rolls, and wherein said intermediate roll bending force adjusting device is controlled according to a fourth disturbance value estimated according to the equation (64) identified in the specification.

3. A method according to claim 2, further comprising the step of obtaining an operation amount of said intermediate roll bending force adjusting device, according to the equation (62) identified in the specification, on the basis of said estimated disturbance values estimated according to said equation (64).

4. A method according to claim 1, wherein said strain distribution of the rolled strip is calculated according to the equation (a) identified in the specification.

5. A method according to claim 1, further comprising the step of obtaining operation amounts of said tilt adjusting device, said bending force differential adjusting device and said work roll bending force adjusting device according to the equations (39), (49) and (54) identified in the specification, respectively, on the basis of said estimated first, second and third disturbance values estimated according to said equations (46), (51) and (59), respectively.

* * * * *